US012529366B2

(12) United States Patent
Elgetz et al.

(10) Patent No.: US 12,529,366 B2
(45) Date of Patent: Jan. 20, 2026

(54) MEMBRANE PUMP

(71) Applicant: ProMinent GmbH, Heidelberg (DE)

(72) Inventors: Roland Elgetz, Übstadt-Weiher (DE); Jörg Maltry, Nußloch (DE)

(73) Assignee: ProMinent GmbH, Heidelberg (DE)

( * ) Notice: Subject to any disclaimer, the term of this patent is extended or adjusted under 35 U.S.C. 154(b) by 31 days.

(21) Appl. No.: 18/344,997

(22) Filed: Jun. 30, 2023

(65) Prior Publication Data

US 2023/0392591 A1 Dec. 7, 2023

(30) Foreign Application Priority Data

Jun. 6, 2022 (DE) ..... 102022116867.0

(51) Int. Cl.
*F04B 43/06* (2006.01)
*F04B 13/00* (2006.01)

(52) U.S. Cl.
CPC ..... *F04B 43/06* (2013.01); *F04B 13/00* (2013.01)

(58) Field of Classification Search
CPC ..... F04B 13/00; F04B 43/06; F04B 43/067; F04B 43/073
USPC ..... 417/395
See application file for complete search history.

(56) References Cited

U.S. PATENT DOCUMENTS 5,145,331 A * 9/1992 Goes ..... F04B 43/067 417/63
6,481,982 B1 * 11/2002 Yokomichi ..... F04B 43/0081 251/30.01
8,272,850 B2 * 9/2012 Stenberg ..... F04B 35/045 417/413.1
2002/0155012 A1 10/2002 Zabar

FOREIGN PATENT DOCUMENTS

CH 293763 A 10/1953
DE 805825 B 5/1951
DE 1453491 C 10/1969
DE 2410723 A1 9/1974
DE 8424759 U1 4/1986
DE 4439823 C1 1/1996
(Continued)

OTHER PUBLICATIONS

Search Report issued on Mar. 7, 2024, in corresponding German Application No. 102023114567.3, 7 pages.
(Continued)

*Primary Examiner* — Philip E Stimpert
(74) *Attorney, Agent, or Firm* — Maier & Maier, PLLC

(57) ABSTRACT

A hydraulically driven membrane pump for conveying a fluid, including a pumping chamber, a working chamber and a membrane which separates the pumping chamber and the working chamber in a fluid-tight manner, and means for reciprocating the membrane between a suction stroke position and a pressure stroke position, wherein the pumping chamber comprises at least one suction port through which the fluid to be conveyed is sucked into the pumping chamber
(Continued)

in the suction stroke, and at least one discharge port through which the fluid to be conveyed is discharged from the pumping chamber in the pressure stroke, the membrane being connected on the working chamber side to a pull rod which is resiliently biased in the direction of the movement of the suction stroke.

10 Claims, 5 Drawing Sheets

(56) References Cited

FOREIGN PATENT DOCUMENTS

| | | | | |
|---|---|---|---|---|
| DE | 19854243 | C2 | 10/2000 | |
| DE | 10139873 | A1 * | 2/2002 | ..... F04B 43/02 |
| DE | 69716432 | T2 | 2/2003 | |
| DE | 102018109347 | B4 | 10/2021 | |
| GB | 562576 | A | 7/1944 | |
| GB | 2395237 | A | 5/2004 | |
| JP | 2001304316 | A | 10/2001 | |

OTHER PUBLICATIONS

Search Report issued on Mar. 13, 2023, in corresponding German Patent Application No. 102022116867.0, 9 pages.

* cited by examiner

MEMBRANE PUMP

FIELD

The present invention relates to a hydraulically driven membrane pump for pumping a fluid having a pumping chamber, a working chamber, and a pumping membrane which separates the pumping chamber and the working chamber in a fluid-tight manner. Furthermore, a device is provided for moving the membrane back and forth between a suction stroke position at the end of a suction stroke and a pressure stroke position at the end of a pressure stroke. In the suction stroke position at the end of the suction stroke, the volume of the pumping chamber is greater than in the pressure stroke position at the end of the pressure stroke.

BACKGROUND

The pumping chamber of such membrane pumps has at least one suction port, through which the fluid to be pumped is sucked into the pumping chamber from a suction line in the suction stroke, and at least one discharge port, through which the fluid to be pumped is discharged through a discharge line in the discharge stroke. Suction port and discharge port are each connected to a one-way valve, whereby in the suction stroke the one-way valve is opened at the suction port and closed at the discharge port, and conversely in the pressure stroke the one-way valve is closed at the suction port and opened at the discharge port.

A basic distinction is made between hydraulically driven membrane pumps and magnetically driven membrane pumps. In both hydraulically driven membrane pumps and magnetically driven membrane pumps, the membrane can be spring-loaded in the direction of the suction stroke position. In this case, the resilient preloading can be effected by the nature and arrangement of the membrane itself and/or by a device, usually a pull rod, which is connected to the membrane and preloaded on the working chamber side by means of a spring in the direction of the suction stroke movement.

In hydraulically driven membrane pumps, a hydraulic fluid located in the working chamber is usually pressurized in an oscillating manner by means of a moving piston to cause the reciprocation of the membrane between the suction stroke position and the pressure stroke position. To initiate the pressure stroke, the fluid pressure in the working chamber is increased to such an extent that the membrane moves against a pressure in the pumping chamber and against any resilient bias of the membrane acting in the direction of the suction stroke position, thereby reducing the volume in the pumping chamber and ejecting fluid in the pumping chamber into the discharge line via the discharge port.

To initiate the suction stroke, the fluid pressure in the working chamber is reduced to such an extent that the membrane moves again in the direction of the suction stroke position. Due to the associated increase in the volume of the pumping chamber, the pressure in the pumping chamber also decreases. If the pressure in the pumping chamber falls below a value specified by the pressure in the suction line (usually ambient pressure) and a value specified at the one-way valve, the one-way valve at the suction port opens and fluid to be pumped is sucked out of the suction line via the suction port into the pumping chamber.

In the hydraulically driven membrane pump, a major force component for moving the membrane in the suction stroke towards the suction stroke position results from the reduced fluid pressure in the working chamber and the resulting pressure difference between the pumping chamber and the working chamber. The lower the pressure reduced in the suction stroke in the working chamber, the greater this pressure difference contributing to membrane movement. Since in the pumping chamber the pressure in the suction stroke decreases or must decrease compared to the pressure in the pressure stroke in order to effect the suction of the fluid from the suction line, and the lowering of the pressure in the working chamber to produce a pressure difference for moving the membrane is also limited, a resilient pretensioning of the membrane in the direction of the suction stroke position to support the suction stroke has proven to be advantageous, and in many applications also necessary, in order to realize the suction stroke with sufficient speed and also completely up to the suction stroke position before the next pressure stroke is triggered. In the hydraulically driven membrane pump, both the pressure stroke and the suction stroke are thus effected by the pressure of the hydraulic fluid in the working chamber. The spring preload of the membrane serves only to support the suction stroke.

In magnetically driven membrane pumps, on the other hand, only the pressure stroke (alternatively only the suction stroke) is usually triggered by activating an electromagnet which is fixed in the working chamber and which, when activated (energized), interacts with a ferromagnetic core connected to the membrane and moves this core together with the membrane in the direction of the pressure stroke position. For the membrane to move in the opposite direction, usually in the direction of the suction stroke position, a spring preload of the membrane is absolutely necessary in conventional magnetically driven membrane pumps. The spring force is the only force component for the movement of the membrane in the respective direction. In magnetically driven membrane pumps, it is also not necessary for the working chamber to be fluid-tight.

In known membrane pumps, both hydraulically and magnetically driven membrane pumps, the resilient pretensioning of the membrane is realized by connecting a pull rod, which is arranged centrally to the membrane and perpendicular to the plane of the membrane, to the membrane on the working chamber side. In the case of membranes with membrane anchors, the pull rod can be firmly connected to the membrane anchor or formed integrally with it. The pull rod is preloaded in the direction of the suction stroke movement by means of a pressure spring, which is usually in the form of a coil spring and is arranged coaxially around the pull rod. In the direction of the movement of the pressure stroke, the pressure spring is supported on a fixed element in the working chamber and, in the direction of the movement of the suction stroke, it is supported or fixed on the pull rod, for example by means of a clamping nut, with which subsequent fine adjustment of the spring range and thus of the spring force is possible. Due to the spring structure and the characteristics of such spiral springs, this design, which is common in known membrane pumps, requires a relatively long pull rod and correspondingly large volume in the working chamber of the membrane pump, which necessitates correspondingly large dimensions of the pump housing. However, the pressure spring designed as a spiral spring has the great advantage that the required spring characteristic can be easily selected and adjusted, and subsequent fine adjustment is possible. In hydraulically driven membrane pumps, however, the large volume in the working chamber of the membrane pump and the high volume of hydraulic fluid required as a result have a detrimental effect on the efficiency of the pump. In magnetically driven membrane pumps, this does not play a significant role, as no hydraulic fluid is used. Therefore, the advantages of the magnetically driven membrane pump are outweighed by those of the pressure spring in the form of a spiral spring.

One problem associated with hydraulically driven membrane pumps is the accumulation of small air bubbles in the working chamber during operation. The more air that accumulates in the working chamber, the more the efficiency of hydraulically driven membrane pumps drops because the air, unlike the hydraulic fluid, is highly compressed under the high pressures, which in turn counteracts the rapid pressure buildup in the working chamber during the pressure stroke. The adverse effects of the accumulation of air in the working chamber are greater the larger the volume in the working chamber. In magnetically driven membrane pumps, on the other hand, the presence of air in the working chamber has no adverse effects, since the pressure and suction strokes are not caused by oscillating pressure by means of hydraulic fluid, but by the electromagnetic force on the one hand and the restoring spring force on the other. As a rule, the working chamber of magnetically driven membrane pumps therefore does not need to be sealed against the entry of air.

Since the entry of air into the working chamber of hydraulically driven membrane pumps cannot be completely prevented in the long term due to the oscillating piston movement, vent bores are provided in the working chamber of hydraulically driven membrane pumps through which air that has entered the working chamber can be discharged again. One difficulty is to feed the air bubbles inside the working chamber to the vent bores efficiently and in a targeted manner so that they can be discharged quickly. The air bubbles often accumulate on the pressure spring, which is designed as a coil spring. The large volume in the working chamber and the central arrangement of the pressure spring make it difficult to discharge the air bubbles efficiently and in a targeted manner.

Based on the prior art described, it was therefore the problem of the present invention to provide a hydraulically driven membrane pump of the type mentioned above which overcomes the disadvantages of the prior art and, in particular, permits improved efficiency.

SUMMARY

According to the invention, this problem is solved by a hydraulically driven membrane pump for pumping a fluid, having a pumping chamber, a working chamber and a pumping membrane which separates the pumping chamber and the working chamber from one another in a fluid-tight manner, and having a device for moving the membrane back and forth between a suction stroke position and a pressure stroke position, the pumping chamber having at least one suction port through which the fluid to be conveyed is sucked into the pumping chamber in the suction stroke, and having at least one discharge port through which the fluid to be conveyed is discharged from the pumping chamber in the pressure stroke, wherein the membrane is connected on the working chamber side to a pull rod which is resiliently biased in the direction of the movement of the suction stroke when the membrane is in the pressure stroke position, wherein the membrane pump has a leaf spring guide disc for resiliently biasing the pull rod in the working chamber, which leaf spring guide disc is arranged perpendicular to the direction of movement of the suction stroke, wherein the leaf spring guide disc has a peripheral area extending from its peripheral edge in the direction of the pull rod, which is fixed at least in sections in the working space, and the leaf spring guide disc has a plurality of leaf spring sections extending from the peripheral area to the pull rod, which are engaged with or fixed to the pull rod remote from the peripheral area of the leaf spring guide disc.

When reference is made herein to an arrangement of the leaf spring guide disc perpendicular to the direction of movement of the suction stroke, this describes the arrangement of an imaginary plane through at least three points on the peripheral edge of the leaf spring guide disc and does not preclude the leaf spring guide disc as a whole from also having curved or otherwise profiled sections, provided that the function of the leaf spring guide disc described herein remains assured.

The present invention has significant advantages over known hydraulically driven membrane pumps or membrane metering pumps. The leaf spring guide disc according to the invention replaces the spiral spring used in the prior art for preloading the membrane in the direction of the suction stroke movement. At the same time, it is suitable for guiding the pull rod without the need for a complex bearing. By arranging the leaf spring guide disc perpendicular to the direction of movement of the suction stroke, it requires much less space in the direction of the stroke. In addition, the pull rod can be designed to be much shorter than in known membrane pumps, so that the working space can be designed with less volume overall. This makes it possible to achieve a smaller pump size. In addition, the smaller volume of the working chamber results in a higher efficiency of the pump. The pump can be used in a wider performance range, and small delivery volumes under high pressure are possible. The smaller volume of the working chamber also allows more efficient and targeted venting of the hydraulics. The arrangement of the leaf spring guide disc according to the invention perpendicular to the stroke direction in the working chamber improves the discharge of air bubbles to the vent bore(s), which inevitably accumulate in the hydraulic fluid in the working chamber during operation of the hydraulically driven membrane pump.

Expediently, one or more vent bores are arranged on the side of the leaf spring guide disc facing away from the membrane in the wall of the working chamber. It has been shown that this arrangement of vent bores in conjunction with the leaf spring guide disc according to the invention ensures particularly efficient and targeted removal of air bubbles from the working chamber. It is assumed that in this arrangement the leaf spring guide disc contributes to the transport of the air bubbles to the vent bores.

Perpendicular to the stroke direction, the leaf spring guide disc according to the invention is preferably not larger than the outer diameter of the membrane, so that the dimensions of the pump head in this direction perpendicular to the stroke direction are not adversely affected by the leaf spring guide disc according to the invention.

A further advantage of the leaf spring guide disc according to the invention is that the pull rod bearing, which is necessary in known membrane pumps and is structurally complex, can be omitted. By arranging the leaf spring guide disc and engaging or fixing the leaf spring sections on the pull rod, the pull rod can be centered and preloaded and guided in the direction of the suction stroke movement without the need for an additional bearing. In the pressure stroke, the membrane is moved in the direction of the pressure stroke position, entraining the pull rod, which in turn entrains the ends of the leaf spring sections of the leaf spring guide disc that are engaged with or fixed to the pull rod and biases them in the direction of the suction stroke movement. By eliminating the costly bearing, the pump also requires less oil to lubricate the bearing and the pull rod guided therein.

The hydraulically driven membrane pump according to the invention also permits less expensive manufacture, since components required in known hydraulically driven membrane pumps can be omitted, such as those for the bearing of the pull rod, or components can be made smaller or shorter and therefore require less material, such as the pull rod. The design of the membrane pump according to the invention not only eliminates the need for costly bearings for the pull rod, but also makes the membrane pump less susceptible to faults and failures overall. Expediently, the membrane of the membrane pump according to the invention is formed with a substantially circular circumference and the pull rod extends coaxially to the axis running through the center of the membrane and perpendicularly thereto in the working chamber.

In a particularly preferred embodiment of the invention, the leaf spring guide disc is circular in shape and the leaf spring sections extend from the peripheral area in a radial direction toward the pull rod and are engaged with or secured to the pull rod at their ends remote from the peripheral area in the radial direction. Examples of this particularly preferred embodiment are shown in the appended FIGS. 5 and 6. The leaf spring sections extending radially inwardly from the peripheral area of the leaf spring guide disc toward the pull rod are defined or bounded and separated from each other by cutouts which also extend from the peripheral area of the leaf spring guide disc between the leaf spring sections toward the pull rod. The shape of the leaf spring sections or cutouts extending in the radial direction towards the pull rod can be varied and, by adapting their shape, allows the properties of the leaf spring guide discs in terms of spring characteristics to be defined almost without restriction to different spatial specifications and to the material of the leaf spring guide disc.

The particular advantage of this embodiment of the leaf spring guide disc according to the invention is that it ensures a particularly efficient and targeted removal of air bubbles from the working space. It is assumed that air bubbles can be transported particularly efficiently along the radially extending leaf spring sections and cutouts and fed to the vent bores.

The number of leaf spring sections extending radially from the peripheral area towards the pull rod is in principle not restricted and can be selected according to the requirements of the spring characteristics. However, it has proved advantageous, in particular for good centering and guidance of the pull rod, if the leaf spring guide disc has 4 to 13 or 5 to 11 or 6 to 9 leaf spring sections extending from the peripheral area towards the pull rod.

In alternative embodiments of the invention, the leaf spring guide disc is also circular in shape, but the leaf spring sections may also extend from the peripheral area toward the pull rod along a curved, bent or spiral path and are engaged with or secured to the pull rod at their ends remote from the peripheral area. This embodiment also allows for a small volume in the working space, but these embodiments have not been observed to provide as superior transport of air bubbles to the vent bores as the embodiment with leaf spring sections extending radially from the peripheral area toward the pull rod.

Expediently, the leaf spring guide disc has an aperture centrally, i.e. around its center, preferably a circular disc-shaped or polygonal aperture which is circumscribed by the free ends of the leaf spring sections of the leaf spring guide disc and through which the pull rod is passed. When it is said that the free ends of the leaf spring sections of the leaf spring guide disc circumscribe the aperture, this does not necessarily mean that the ends of the leaf spring sections define the entire circumference of the aperture, but that they terminate at least at one edge of the aperture. The free ends of the leaf spring sections may also be curved in the direction of the aperture or the center of the leaf spring guide disc, for example convexly curved, so that the aperture is substantially circular disc shaped or polygonal, but with cutouts extending radially outward from the circular disc shape or polygonal shape.

A plurality of leaf spring sections extend inwardly from the peripheral area of the leaf spring guide disc to the pull rod and are in engagement or abutment therewith. Therefore, the pull rod suitably has one or more cutouts or abutment surfaces for engagement or abutment with the leaf spring sections of the leaf spring guide disc.

Expediently, the pull rod has a section, preferably a cylindrical section, extending through the central aperture in the leaf spring guide disc. In one embodiment, this section of the pull rod is joined on the side of the leaf spring guide disc facing away from the membrane by a radially outwardly extending widening with an abutment surface for membrane-side abutment of the free ends of each of the leaf spring sections opposite the peripheral area. In the pressure stroke of the membrane pump, when the membrane moves in the direction of the pressure stroke position, it entrains the pull rod firmly connected to the membrane and the free ends of the leaf spring sections in engagement or contact therewith, whereby the leaf spring sections are bent in the direction of the membrane and a resilient bias of the membrane or the pull rod in the suction stroke direction is effected.

It is expedient that the contact surface or the contact surfaces on the pull rod and the free ends of each of the leaf spring sections lying thereon are designed, coordinated and arranged in such a way that the ends of the leaf spring sections lying thereon can slide along the contact surface during the movement of the pull rod in the suction and pressure stroke without disengaging from the pull rod, since the extension of the leaf spring sections in the radial direction from the peripheral area changes when the leaf spring sections are bent in the stroke direction. For example, in a continuously planar leaf spring guide disc, the radial extent of the leaf spring sections is greatest when the leaf spring sections are straight, i.e., in the non-preloaded state, while the free ends of the leaf spring sections move away from the center axis of the pull rod when bending to achieve preload.

In a preferred embodiment of the invention, the leaf spring guide disc is made of spring steel. However, alternative suitable materials are encompassed by the invention.

BRIEF DESCRIPTION OF THE FIGURES

Further advantages, features and possible applications of the present invention will become apparent from the following description of an embodiment according to the invention and the accompanying figures. In the figures, like elements are designated by like reference signs.

DETAILED DESCRIPTION

Figure 1:
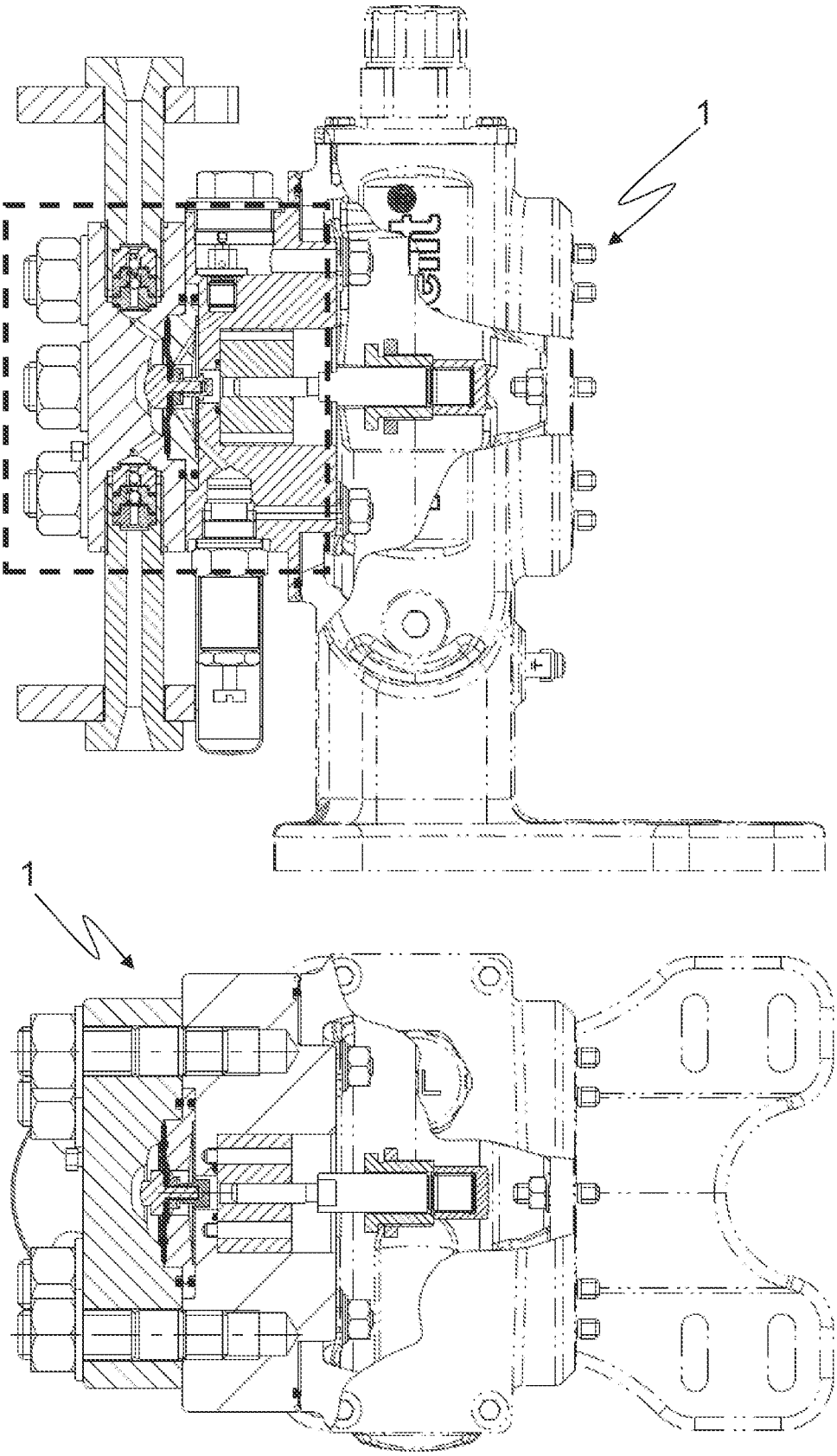
FIG. 1 shows in the upper representation a broken view from the side and in the lower representation a broken view from above of an embodiment of a hydraulic membrane metering pump according to the invention with the membrane in suction stroke position.
Figure 2:
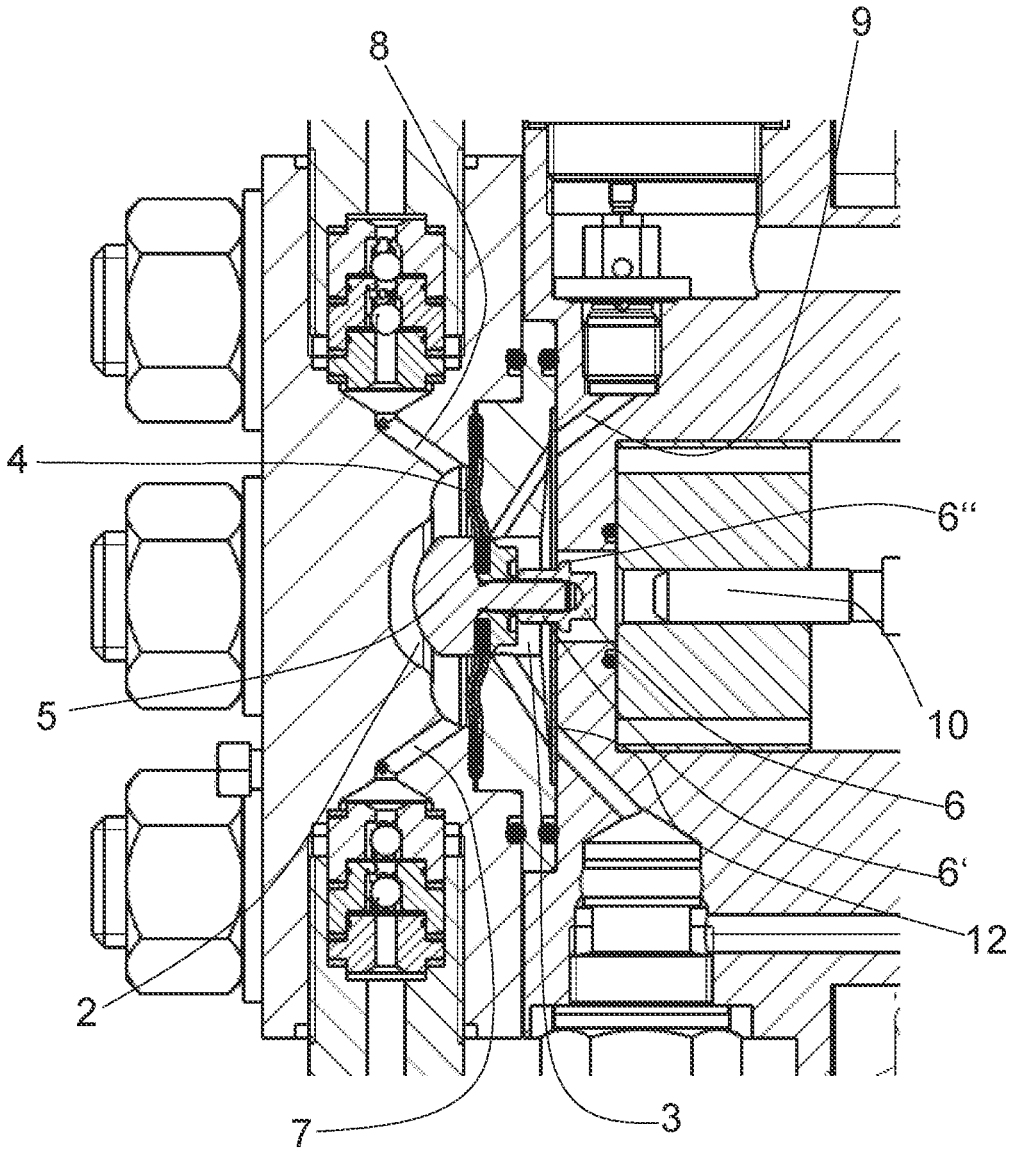
FIG. 2 shows an enlarged view of the section interruptedly framed in the upper representation in FIG. 1.
Figure 3:
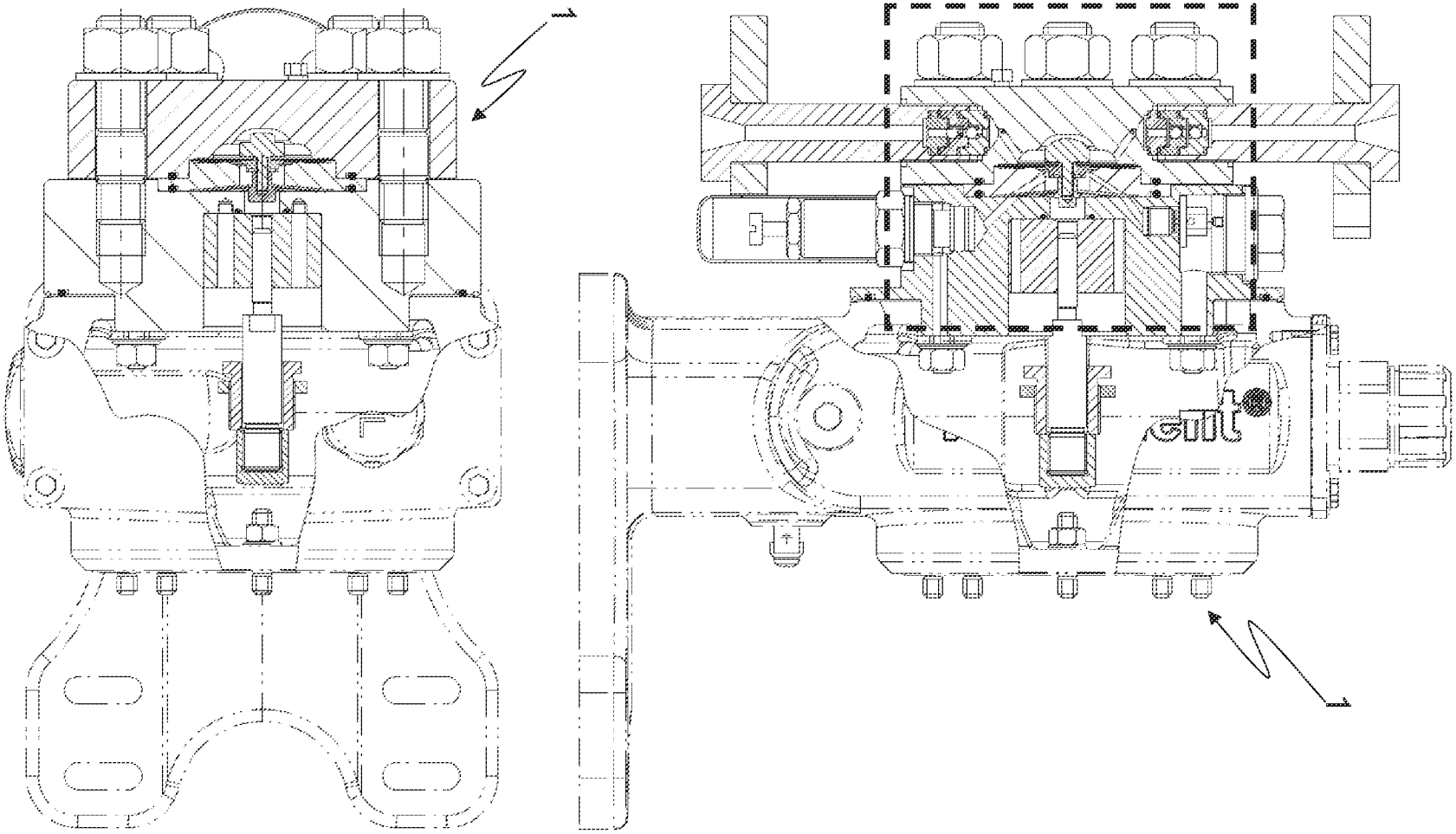
FIG. 3 shows in the upper representation a broken view from the side and in the lower representation a broken view from above of an embodiment of the hydraulic membrane metering pump according to FIG. 1 with the membrane in pressure stroke position.
Figure 4:
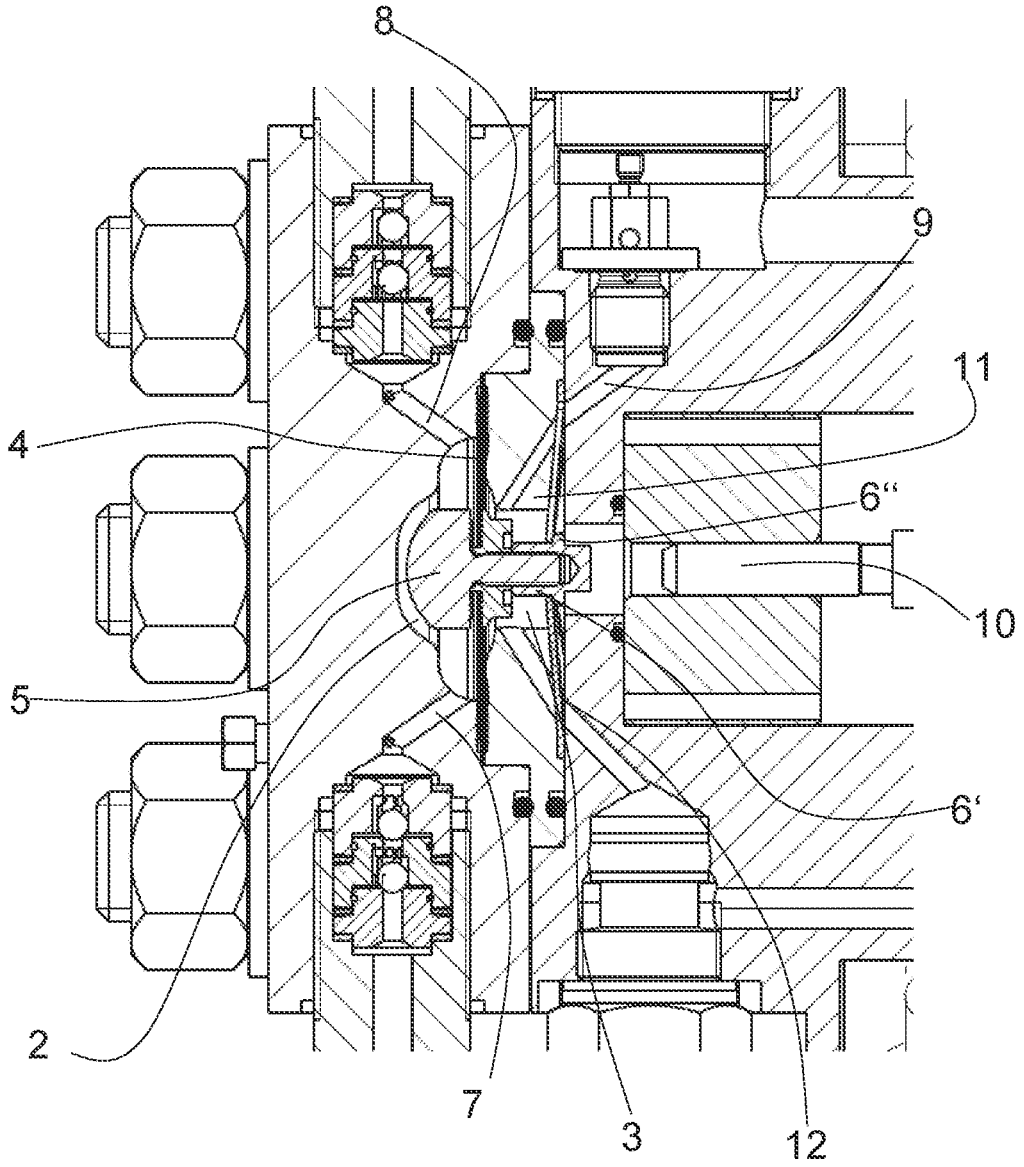
FIG. 4 shows an enlarged view of the section interruptedly framed in the upper representation in FIG. 3.

FIGS. 1 and 3 each show in the upper representation a broken view from the side and in the lower representation a broken view from above of an embodiment of a hydraulically driven membrane pump 1 according to the invention for conveying a fluid (membrane metering pump) with the membrane in suction stroke position (FIG. 1) and in pressure stroke position (FIG. 3), respectively, and FIGS. 2 and 4 each show enlarged representations of the cutouts framed interruptedly in FIGS. 1 and 3, respectively. The membrane pump 1 has a pumping chamber 2 and a working chamber 3 as well as a membrane 4 (pumping membrane) made of a flexible material, which is essentially circular disc-shaped in plan view and is clamped at its circumferential edge in the housing of the pump head in such a way that it separates the cavities of the pumping chamber 2 and the working chamber 3 from each other in a fluid-tight manner.

An aperture is provided in the center of the flexible membrane 4, through which a membrane core 5 extends from the pumping chamber 2 into the working chamber 3 and clamps the edges of the aperture in the membrane 4 in a fluid-tight manner. A section of the membrane core 5 extends in the working chamber in the stroke direction of the membrane coaxially with the axis passing through the center of the membrane and perpendicular to it. The pull rod 6 is fixed to this section of the membrane core 5 in this embodiment and also extends in the stroke direction of the membrane.

The pumping chamber 2 of the membrane pump 1 has at least one suction port 7, through which the fluid to be pumped is sucked into the pumping chamber from a suction line in the suction stroke, and at least one discharge port 8, through which the fluid to be pumped is discharged through a discharge line in the pressure stroke. Suction port and discharge port are each connected to a one-way valve, whereby in the suction stroke the one-way valve at the suction port is opened and closed at the discharge port, and conversely in the pressure stroke the one-way valve at the suction port is closed and opened at the discharge port.

In the working chamber 3, there is a hydraulic fluid which can be fed and supplied through a hydraulic port and which is oscillatingly pressurized for the suction and pressure strokes of the membrane by means of the reciprocating piston 10 to cause the reciprocation of the membrane between the suction stroke position and the pressure stroke position. To initiate the pressure stroke, the piston 10 is supplied to the working chamber 3 from the position shown in FIGS. 1 and 2, in which the membrane 4 is in the suction stroke position, thereby increasing the fluid pressure in the working chamber 3 to such an extent that the membrane moves against a pressure in the pumping chamber 2 and against a resilient bias of the membrane 4 acting in the direction of the suction stroke position until the membrane 4 reaches the pressure stroke position. FIGS. 3 and 4 show the position of the piston 10 supplied to the working chamber 3 when the membrane 4 is the pressure stroke position. In the pressure stroke, the volume in the pumping chamber 2 is reduced, causing fluid located in the pumping chamber 2 to be expelled into the discharge line through the discharge port 8.

Figure 5:
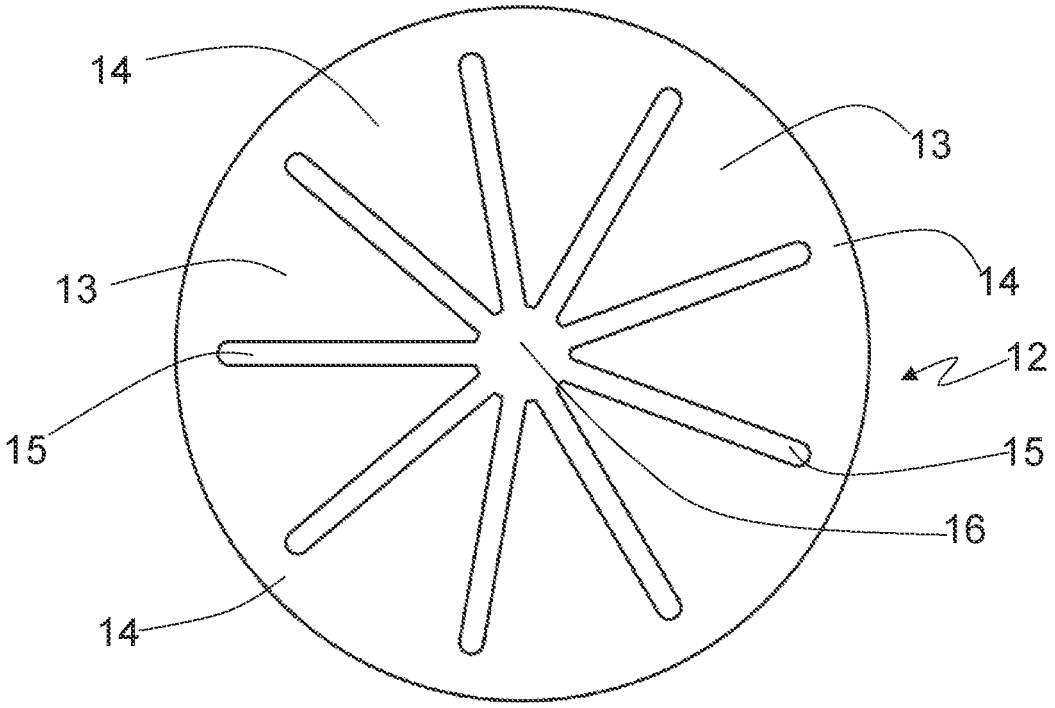
FIG. 5 shows a first embodiment of a leaf spring guide disc according to the invention, as used in the hydraulic membrane metering pump according to FIG. 1.

In the working chamber 3 of the membrane pump 1, a leaf spring guide disc 12 according to the invention is arranged substantially perpendicular to the direction of movement of the suction stroke. In this embodiment, the leaf spring guide disc 12 is formed in a circular disc shape as shown in FIGS. 5 to 8. In the embodiment according to FIGS. 1 to 4, a leaf spring guide disc 12 according to FIG. 5 is provided and shown in cross-section through the center point and through one of the leaf spring sections 13. In this embodiment, the leaf spring guide disc 12 is formed in a continuously flat (flat) manner in the relaxed state. On the side of the leaf spring guide disc 12 facing away from the membrane 4, a vent bore 9 is arranged in the wall of the working chamber for discharging air bubbles from the working chamber.

The leaf spring guide disc 12 has a peripheral area 14 extending from its peripheral edge in the direction of the pull rod 6, in which no cutouts 15 are provided. To fix the leaf spring guide disc 12 in the working space, the peripheral area 14 in the present embodiment is clamped between a surface on the supporting disc 11 and a corresponding counter surface, although other fixings are also possible and are within the skill of the person skilled in the art.

From the peripheral area 14 of the leaf spring guide disc 12, a plurality of leaf spring sections 13 extend radially inward to the pull rod and are engaged therewith. In the embodiment shown in FIGS. 1 to 4, the pull rod has a cylindrical section 6' which passes through a circular disc-shaped aperture 16 as shown in FIG. 5. On the side of the leaf spring guide disc 12 facing away from the membrane 4, a radially outwardly extending extension is provided on the pull rod 6 with an abutment surface 6" for engaging the free ends of each of the leaf spring sections 13 opposite the peripheral area 14 by abutment on the membrane side. In the pressure stroke, the membrane 4 is moved in the direction of the pressure stroke position, thereby taking the pull rod 6, which is fixedly connected to the membrane, and the free ends of the leaf spring sections 13, which are in engagement therewith, with generation of a resilient bias in the suction stroke direction to assist the suction stroke.

Expediently, the abutment surface 6" on the pull rod 6 and the free ends of each of the leaf spring sections 13 abutting thereon are so formed, matched and arranged that the abutting ends of the leaf spring sections 13 can slide along the abutment surface 6" during the movement of the pull rod 6 in the suction and pressure strokes without disengaging from the pull rod 6, since the extension of the leaf spring sections 13 in the radial direction from the peripheral area 14 changes when the leaf spring sections 13 are bent in the stroke direction, as described above.

Alternatively, the free ends of the leaf spring sections 13 of the leaf spring guide disc 12 can also be engaged with or fixed to the pull rod 6 at the end face of the latter without the pull rod 6 being passed through the leaf spring guide disc in sections, in which case compensation for the extension of the leaf spring sections 13 in the radial direction is to be provided when the leaf spring sections 13 are bent.

Figure 6:
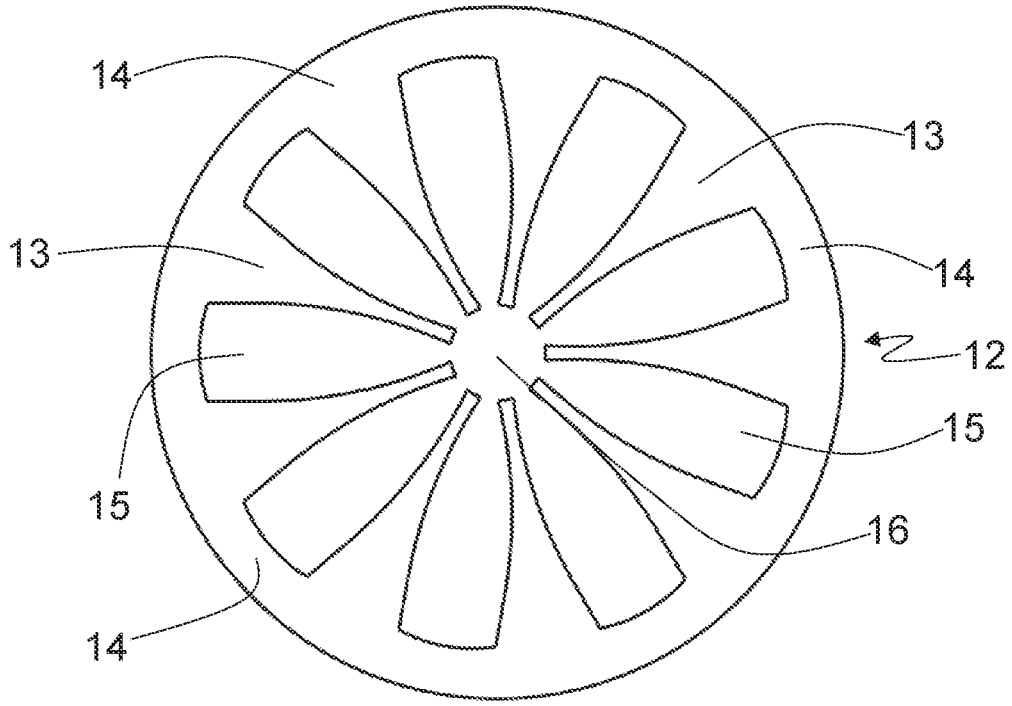
FIG. 6 shows a second embodiment of a leaf spring guide disc according to the invention, as can be used in the hydraulic membrane metering pump according to the invention.

FIGS. 5 and 6 show two embodiments of leaf spring guide discs 12 suitable according to the invention in plan view. Corresponding sections and elements of the leaf spring guide discs shown are designated with the same reference numbers, even though they may have different shapes.

The leaf spring guide discs 12 shown in FIGS. 5 and 6 are expediently made of spring steel and are circular disc-shaped. They have a circular disc-shaped aperture 16 around their center for the pull rod 6 to pass through. It is understood that the aperture 16 in the center of the leaf spring guide disc 12 may also have another shape, for example polygonal, such as triangular, square or polygonal, or even oval, etc. Conveniently, but not necessarily, the shape of the aperture 16 is adapted to the cross-sectional shape of the section of the pull rod 6 passing through the aperture.

The leaf spring guide discs 12 of FIGS. 5 and 6 according to the invention have, starting from their peripheral edge, a peripheral area 14 which is provided and dimensioned for fixing the leaf spring guide discs 12 in the working chamber of the membrane pump, the fixing in the working chamber preferably being effected by clamping between two clamping surfaces. However, other fixings are also possible and encompassed by the present invention, such as a fixation by gluing, welding, screwing, riveting, etc., or combinations thereof.

From the peripheral area 14 of the leaf spring guide discs 12 of FIGS. 5 and 6, a plurality of leaf spring sections 13 extend radially toward the center of the pull rod to the aperture 16. Starting from the peripheral area 14, the leaf spring sections 13 are bounded and separated from each other by cutouts 15. The shape of the radially extending leaf spring sections 13 or cutouts can be varied within wide limits and permits almost unrestricted adaptation of the properties of the leaf spring guide discs 12 in terms of spring characteristics to different spatial specifications and to the material of the leaf spring guide disc. In the design of the leaf spring guide disc 12 according to FIG. 5, the cutouts are formed as narrow slots and the leaf spring sections 13 extending radially from the peripheral area 14 have a triangular shape that narrows towards the center. In the embodiment shown in FIG. 6, the cutouts 15 at the peripheral area 14 of the leaf spring guide disc 12 are wider and taper toward the center of the leaf spring guide disc 12.

For purposes of the original disclosure, it is pointed out that all features as they appear to a person skilled in the art from the present description, the drawings and the claims, even if they have been specifically described only in connection with certain other features, may be combined both individually and in any combination with other of the features or groups of features disclosed herein, unless it has been expressly excluded or technical circumstances make such combinations impossible or futile. A comprehensive, explicit description of all conceivable combinations of features is omitted here only for the sake of brevity and readability of the description.

While the invention has been illustrated and described in detail in the drawings and the foregoing description, this description of embodiments is by way of example only and is not intended to limit the scope of protection as defined by the claims. The invention is not restricted to the embodiments shown.

Variations of the disclosed embodiments will be obvious to those skilled in the art from the drawings, the description and the appended claims. In the Claims, the word "comprising" does not exclude other elements, and the indefinite article "a" or "an" does not exclude a plurality. The mere fact that certain features are claimed in different claims does not preclude their combination.

The invention claimed is:

1. A hydraulically driven membrane pump for pumping a fluid, comprising: a pumping chamber, a working chamber and a membrane which separates the pumping chamber and the working chamber from one another in a fluid-tight manner, and having a pull rod for moving the membrane back and forth between a suction stroke position and a pressure stroke position, wherein the pumping chamber has at least one suction port through which the fluid to be conveyed is sucked into the pumping chamber in the suction stroke, and has at least one discharge port through which the fluid to be conveyed is expelled from the pumping chamber in the pressure stroke, wherein at least one suction port and the at least one discharge port are each connected to a one-way valve, wherein the membrane is connected on the working chamber side to the pull rod which is resiliently biased in the direction of the movement of the suction stroke when the membrane is in the pressure stroke position, wherein the membrane pump has a leaf spring guide disc for the resilient preloading of the pull rod in the working chamber, which leaf spring guide disc is arranged perpendicular to the direction of movement of the suction stroke, wherein the leaf spring guide disc has a peripheral area extending from its peripheral edge in the direction of the pull rod, which is fixed at least in sections in a stationary manner in the working chamber, and the leaf spring guide disc has a plurality of leaf spring sections, each leaf spring section extending from the peripheral area to a respective radially inward free end, which are engaged with or fixed to the pull rod remote from the peripheral area of the leaf spring guide disc, wherein the free ends are circumferentially spaced from each other; and wherein at least one vent bore is formed in the wall of the working chamber on the side of the leaf spring guide disc facing away from the membrane.

2. The hydraulically driven membrane pump according to claim 1, wherein the membrane is formed with a circular circumference and the pull rod extends coaxially with the axis passing through the center of the membrane and perpendicular thereto in the working chamber.

3. The hydraulically driven membrane pump according to claim 1, wherein the leaf spring guide disc is formed in the shape of a circular disc.

4. The hydraulically driven membrane pump according to claim 1, wherein the pull rod further comprises one or more cutouts or abutment surfaces for engagement or abutment with the leaf spring sections of the leaf spring guide disc.

5. The hydraulically driven membrane pump according to claim 1, wherein the leaf spring guide disc has an aperture around the center thereof, a circular disc-shaped or polygonal aperture which is bounded by the free ends of the leaf spring sections of the leaf spring guide disc and through which the pull rod is passed.

6. The hydraulically driven membrane pump according to claim 1, wherein the leaf spring guide disc has 4 to 13 leaf spring sections extending from the peripheral area towards the pull rod.

7. The hydraulically driven membrane pump according to claim 1, wherein cutouts are provided between the leaf spring sections of the leaf spring guide disc, which cutouts extend from the peripheral area of the leaf spring guide disc between the leaf spring sections towards the pull rod.

8. The hydraulically driven membrane pump according to claim 1, wherein the leaf spring guide disc is made of spring steel.

9. The hydraulically driven membrane pump according to claim 6, wherein the leaf spring guide disc has 5 to 11 leaf spring sections extending from the peripheral area towards the pull rod.

10. The hydraulically driven membrane pump according to claim 1, wherein the leaf spring guide disc has 6 to 9 leaf spring sections extending from the peripheral area towards the pull rod.

* * * * *